US009968992B2

(12) United States Patent
Roberts

(10) Patent No.: US 9,968,992 B2
(45) Date of Patent: May 15, 2018

(54) SYSTEM AND METHOD FOR USING CLOTH FILTERS IN AUTOMATED VERTICAL MOLDING

(71) Applicant: Michael Roberts, Elkhorn, WI (US)

(72) Inventor: Michael Roberts, Elkhorn, WI (US)

( * ) Notice: Subject to any disclaimer, the term of this patent is extended or adjusted under 35 U.S.C. 154(b) by 287 days.

(21) Appl. No.: 14/686,906

(22) Filed: Apr. 15, 2015

(65) Prior Publication Data

US 2016/0221225 A1 Aug. 4, 2016

Related U.S. Application Data

(63) Continuation-in-part of application No. 14/610,967, filed on Jan. 30, 2015, now Pat. No. 9,481,030.

(51) Int. Cl.

| | |
|---|---|
| ***B29C 33/00*** | (2006.01) |
| ***B22C 9/08*** | (2006.01) |
| ***B22C 19/00*** | (2006.01) |
| ***B22C 23/00*** | (2006.01) |

(52) U.S. Cl.

CPC ..... *B22C 9/086* (2013.01); *B22C 19/00* (2013.01); *B22C 23/00* (2013.01)

(58) Field of Classification Search

CPC ..... B22C 9/0086; B22C 19/00; B22C 23/00; B01D 29/096; B01D 19/0018; C21B 7/12

USPC ..... 164/134, 358; 210/350–352; 264/219

See application file for complete search history.

(56) References Cited

U.S. PATENT DOCUMENTS

| | | | | |
|---|---|---|---|---|
| 4,640,497 | A * | 2/1987 | Heamon | C22B 9/023 210/773 |
| 4,909,836 | A * | 3/1990 | El-Kaddah | B03C 1/23 266/227 |
| 5,556,592 | A * | 9/1996 | Hitchings | B01D 29/096 164/134 |
| 5,676,731 | A | 10/1997 | Hitchings | |
| 6,149,807 | A | 11/2000 | Previero | |
| 6,224,818 | B1 | 5/2001 | Hitchings et al. | |
| 8,656,982 | B2 | 2/2014 | Takashina et al. | |
| 2004/0238152 | A1 | 12/2004 | Campomanes et al. | |

* cited by examiner

*Primary Examiner* — Nahida Sultana

(74) *Attorney, Agent, or Firm* — Absolute Technology Law Group, LLC

(57) ABSTRACT

The present invention is a multipart system and method for using cloth filters in automated vertical molding. The system includes a filter setter, a filter print plate and a filter back shelf. The filter setter removably mounts to a mechanical arm and releasably carries at least one cloth filter between upper and lower jaws. The filter print plate mounts to a ram plate while the filter back shelf mounts to a swing plate. During vertical molding, the ram plate and swing plate compress sand to create a mold. The mounted filter print plate creates at least part of a print aperture into which the filter setter inserts the cloth filter. The apertures created by the filter print plate and the filter back shelf support the cloth filter during the founding process.

17 Claims, 9 Drawing Sheets

SYSTEM AND METHOD FOR USING CLOTH FILTERS IN AUTOMATED VERTICAL MOLDING

CROSS-REFERENCE TO RELATED APPLICATIONS

This application is a continuation-in-part and claims the benefit of U.S. patent application Ser. No. 14/610,967 filed Jan. 30, 2015. The above application is incorporated by reference in its entirety herein.

BACKGROUND OF THE INVENTION

1. Field of Invention

This invention relates to the field of metal founding, and more specifically to system and method for utilizing a united particle type shaping surface.

2. Description of Related Art

Sand casting, also known as sand molded casting, is a metal casting process characterized by using sand as the mold material. The term "sand casting" can also refer to an object produced via the sand casting process. Specialized factories called foundries produce sand castings. Production of over 70% of all metal parts occurs via a sand casting process such as vertical molding processes.

High-volume foundries typically use vertical molding processes. Molds form a line allowing pouring of castings one after another. The process blows a molding sand mixture into a molding chamber using compressed air. The process then compresses the molding sand between patterned plates, each of which ultimately forms half of the pattern of the sand mold. Two sand molds pushed together form a complete internal sand cavity that receives the molten metal.

After compression, one of the chamber plates, a swing plate, swings open and the opposite plate, a ram plate, pushes the finished sand mold onto a conveyor. If desired, the process inserts cores into the sand cavity to form holes and recesses in the finished part. The cycle repeats until a chain of finished molds butt up to each other on the conveyor.

During this process, molten metal pours into sand cavities from a receptacle known in the art as a "pour cup" located on the top of each mold and positioned above a channel in the sand mold called the sprue. An automated device called a filter setter places the filter between the pour cup and the sprue inlet. The filter setter moves the filter into position and then injects the filter into the sand mold. The filter print is the area in the sand into which the filter inserts.

It is desirable to decrease the size of the filter print because the filter print and channels entirely fill with metal during the casting process. Metal left behind in the sprue, channels and filter print is excess metal, requiring removal from the part and repurposing.

It is a problem known in the art that repurposing metal recovered from the sprue, channels and filter print is very costly. An important component of a foundry's profitability is its ability to reduce the amount of repurposed metal and the effective "yield" of the metal that goes into the finished part. If a foundry is able to reduce the amount of metal recoverable from the sprue, channels and filter print by 10%, this could increase foundry yield by 2% to 5%.

There several problems associated with filters known in the art. Ceramic filters must be carefully primed or they fracture and introduce fragments in the casting. Ceramic filters are large, requiring correspondingly larger filter prints to hold them in place. Ceramic filters are also relatively expensive.

One solution is to replace ceramic filters with cloth or mesh filters. Cloth filters generally strain molten metal more quickly than ceramic filters. Previous attempts to use cloth filters failed because filter setters could not hold the cloth filters in place, filter setters could not insert the cloth filters properly, the filter coatings could not withstand metal temperatures or the cloth filters were not supported properly to withstand the downforce of the poured molten metal.

Furthermore, foundry workers, many wearing protective gear such as gloves, find difficulty in separating a single cloth filter from a stack for insertion into the filter setter. The patterned plates used to create the sand mold in the prior art are not capable of molding an insertion cavity allowing effective insertion of the cloth filter into the sand mold. Moreover, during pouring of the molten metal, inadequate mold support of the cloth filter can cause the filter to dislodge from the sand mold.

It is desirable to provide a foundry system optimized for using a cloth filter.

BRIEF SUMMARY OF THE INVENTION

In one embodiment, a system for using cloth filters in automated vertical molding includes a filter setter, a filter print plate and a filter back shelf. The filter setter removably mounted to a mechanical arm. The filter setter includes a housing, at least one upper jaw and at least one lower jaw. At least one cloth filter is releasably located within the filter setter between the upper jaw and the lower jaw. The filter print plate mounts to a ram plate. The filter back shelf removably mounts to a swing plate. The filter back shelf has an L-shaped cross-section including a first shelf leg and a second shelf leg.

In another embodiment, a method for using cloth filters in automated vertical molding includes the step of inserting a cloth filter into a filter setter mounted to a mechanical arm. The method then compresses a quantity of sand with a ram plate having a mounted filter print plate to create at least part of a sand mold. The mounted filter print plate creates at least part of an aperture. Next, the method compresses the quantity of sand with a swing plate having a mounted filter back shelf to create at least part of the sand mold. The method then inserts the cloth filter into the sand mold using the filter setter mounted to the mechanical arm until three edges of the cloth filter rest within the filter print. Next, the method removes the filter setter and the mechanical arm to leave the cloth filter in the sand mold.

BRIEF DESCRIPTION OF SEVERAL VIEWS OF THE DRAWING(S)

FIGS. 1*a*-1*d* illustrate perspective, top, front and side views, respectively, of an exemplary embodiment of a filter separation box of a system for using cloth filters in automated vertical molding.

FIGS. 2*a*-2*d* illustrate perspective, top, front and side views, respectively, of an exemplary embodiment of a filter setter of a system for using cloth filters in automated vertical molding.

FIGS. 3*a*-3*e* illustrate perspective, top, front, side and mounted views, respectively, of an exemplary embodiment of a filter print plate of a system for using cloth filters in automated vertical molding.

FIGS. 4*a*-4*c* illustrate front, side and mounted views, respectively, of an exemplary embodiment of a filter back shelf plate of a system for using cloth filters in automated vertical molding.

TERMS OF ART

Figure 1A:
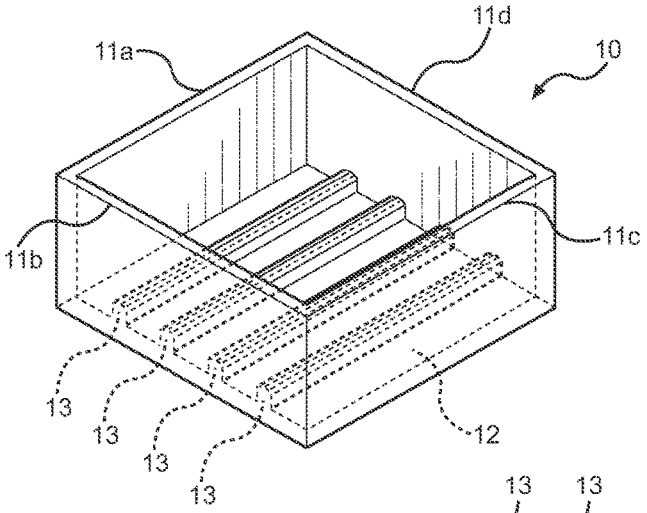
Figure 1B:
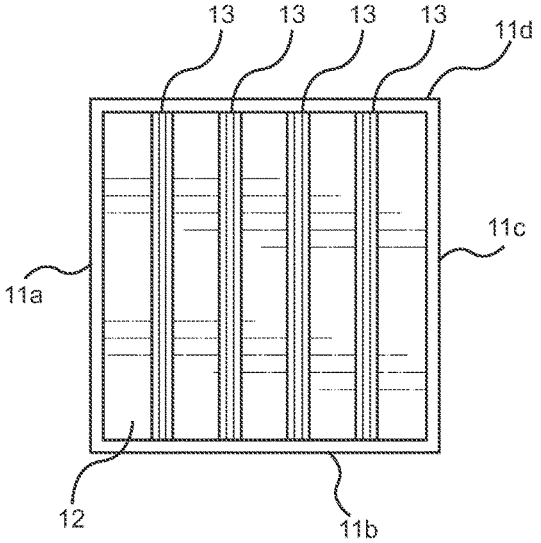
Figure 1C:
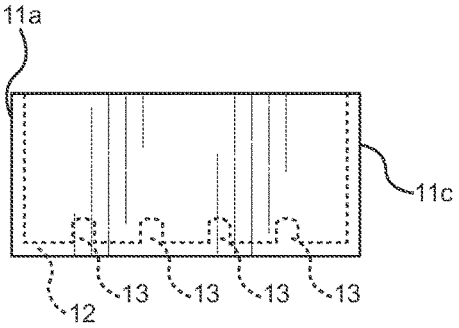
Figure 1D:
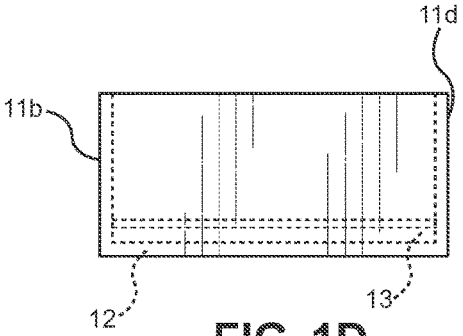
Figure 2A:
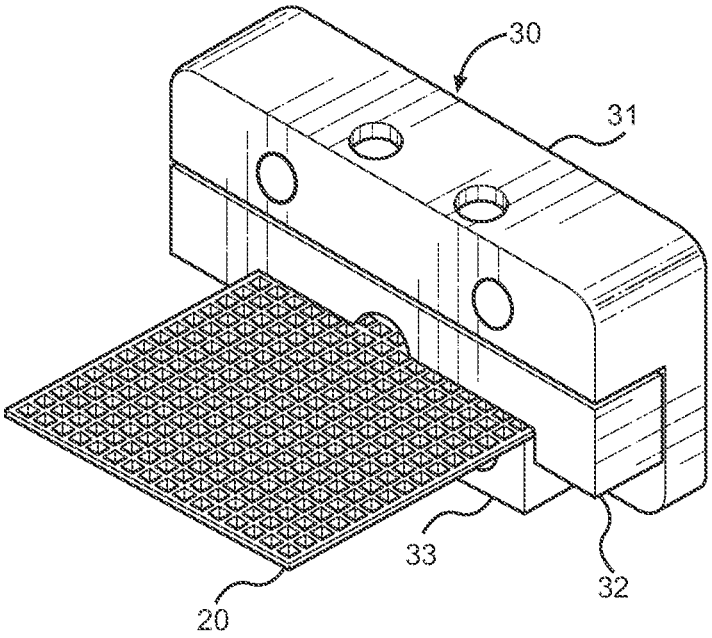
Figure 2B:
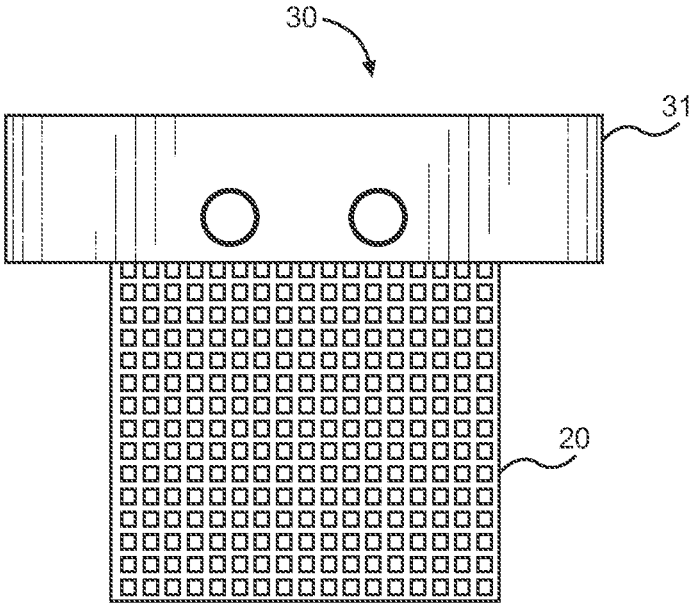
Figure 2C:
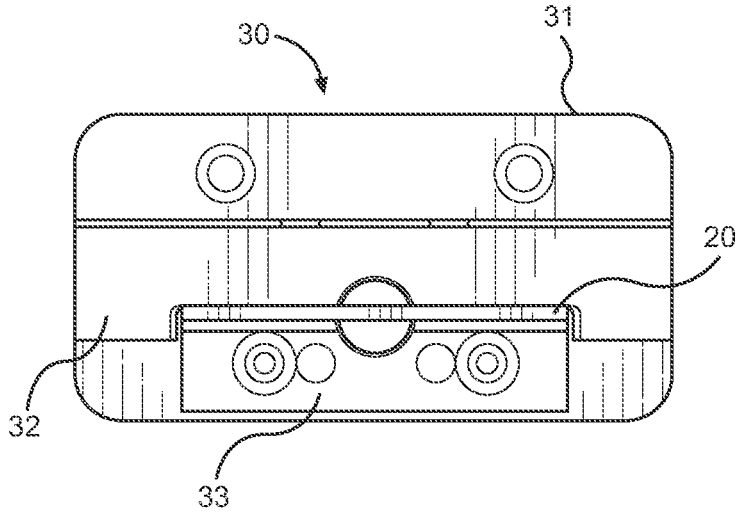
Figure 2D:
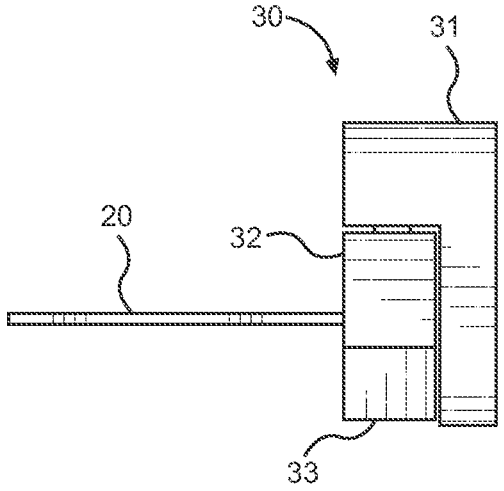

As used herein, the term "cloth filter" means a filter having an interlaced or woven structure.

As used herein, the term "side dimension" means a length or width of an object.

DETAILED DESCRIPTION OF THE INVENTION

FIGS. 1*a*-4*c* and FIG. 6 illustrate exemplary embodiments of a system 100 for using cloth filters 20 in automated vertical molding. System 100 includes an optional filter separation box 10, at least one cloth filter 20, a filter setter 30, a filter print plate 40 and a filter back shelf 50.

FIGS. 1*a*-1*d* illustrate perspective, top, front and side views, respectively, of an exemplary embodiment of filter separation box 10 of system 100 for using cloth filters 20 in automated vertical molding. Filter separation box 10 includes a plurality of walls 11*a*-11*d*, a base 12 and a plurality of separation structures 13. Walls 11*a*-11*d* surround and attach to base 12. Walls 11*a*-11*d* are approximately 6 to approximately 12 inches in height. Base 12 forms a square of approximately 12 inches to approximately 18 inches in length and width. Separation structures 13 are integrally formed with base 12, extending along base 12 between walls 11*b* and 11*d*, and may number between approximately 4 and approximately 10 depending on the size of the cloth filter 20. Separation structures 13 are approximately 0.5 inches to approximately 0.625 inches wide. The height of each separation structure 13 is no less than one-third the length of cloth filter 20. Separation structures 13 are spaced apart no more than two-thirds the length of cloth filter 20.

In the exemplary embodiment, the cross-section of separation structure 13 is a rounded rectangle. In other embodiments, the cross-section of separation structure 13 may be, but is not limited to, a rectangle, a square, a half-circle or a triangle. In certain embodiments using smaller filters, the cross-section of separation structure 13 may be more rounded shapes such as, but not limited to, an arc. Polygonal angles may be sharp or rounded. Separation structure 13 separates cloth filters 20 when stacked cloth filters 20 drop into filter separation box 10, allowing operators to easily remove a single cloth filter 20.

FIGS. 2*a*-2*d* illustrate perspective, top, front and side views, respectively, of an exemplary embodiment of filter setter 30 of system 100 for using cloth filters 20 in automated vertical molding. Filter setter 30 comprises, in part, a housing 31, at least one upper jaw 32 and at least one lower jaw 33. Housing 31 removably mounts to a mechanical arm A. A width of upper jaw 32 is approximately equal to or less than a width of housing 31. A width of lower jaw 33 is approximately equal to or greater than a width of cloth filter 20. In certain embodiments, system 100 includes a plurality of removably attachable upper jaws 32 and a plurality of removably attachable lower jaws 33. This allows upper jaws 32 and lower jaws 33 to be "swapped out" to accommodate cloth filters 20 having different widths.

Filter setter 30 holds a single cloth filter 20 between upper jaw 32 and lower jaw 33 as mechanical arm A travels to the point of filter insertion into a sand mold M. After cloth filter 20 is inserted into a filter cavity formed by a filter print plate 40, an ejection mechanism discharges cloth filter 20 from filter setter 30, leaving cloth filter 30 in sand mold M. Filter setter 30 is fully described in U.S. patent application Ser. No. 14/610,967 filed Jan. 30, 2015, hereby incorporated by reference in its entirety.

FIGS. 3*a*-3*e* illustrate perspective, top, front, side and mounted views, respectively, of an exemplary embodiment of filter print plate 40 of system 100 for using cloth filters 20 in automated vertical molding. Filter print plate 40 mounts to a ram plate R that presses filter print plate 40 into sand mold S to create a cavity into which cloth filter 20 is inserted. Filter print plate 40 creates a cavity high enough to allow an unobstructed insertion of cloth filter 20, but low enough to allow cloth filter 20 to contact the sand during the pouring of molten metal. Foundry plank F at least partially surrounds filter print plate 40 to create an aperture in sand mold M.

Filter print plate 40 has a minimum thickness no less than the thickness of cloth filter 20, and a maximum thickness no greater than twice thickness of cloth filter 20. The side of filter print plate 40 closest to ram plate R is approximately 2-6 mm wider than cloth filter 20. The cavity created by filter print plate 40 is wider than cloth filter 20 to account for insertion of cloth filter 20 into filter setter 30 at oblique angles. Additionally, the cavity created by filter print plate 40 may taper to enable removal of filter print plate 40 without damaging sand mold M. The opening to the cavity may be tapered or chamfered to allow insertion of a warped cloth filter 20.

Figure 3A:
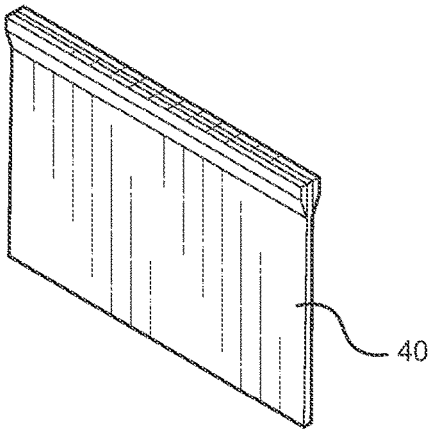
Figure 3B:
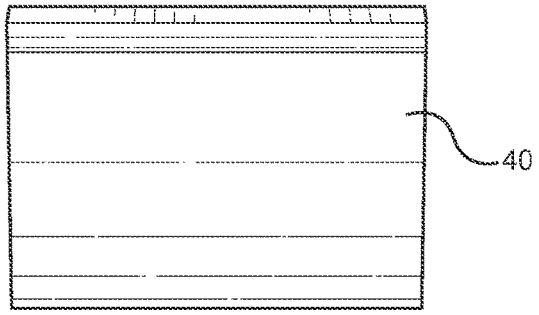
Figure 3C:
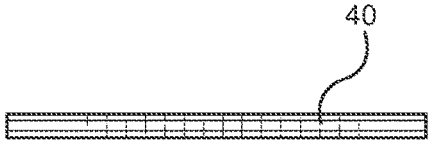
Figure 3D:
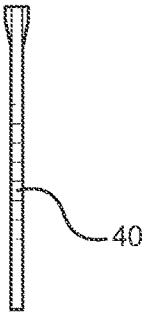
Figure 3E:
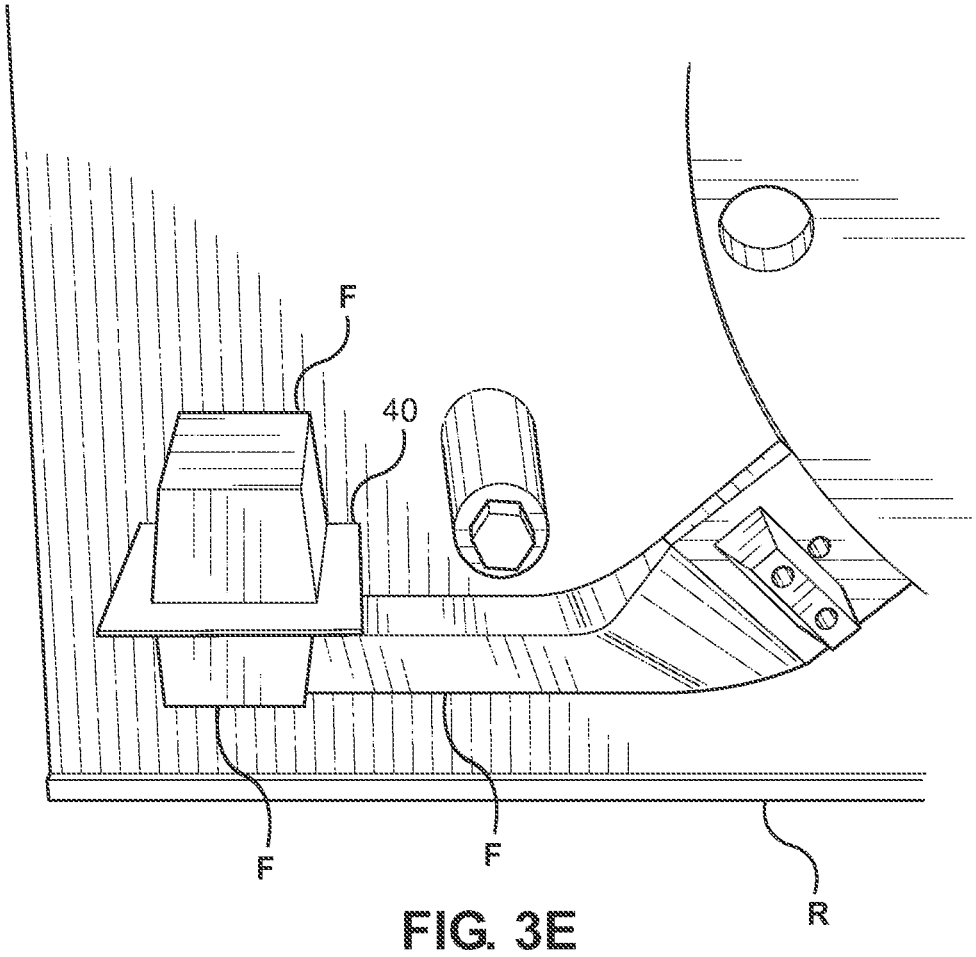

FIG. 3*e* shows filter print plate 40 mounted to ram plate R during the founding process. Foundry plank F at least partially surrounds filter print plate 40 to create an aperture in sand mold M.

Figure 4A:
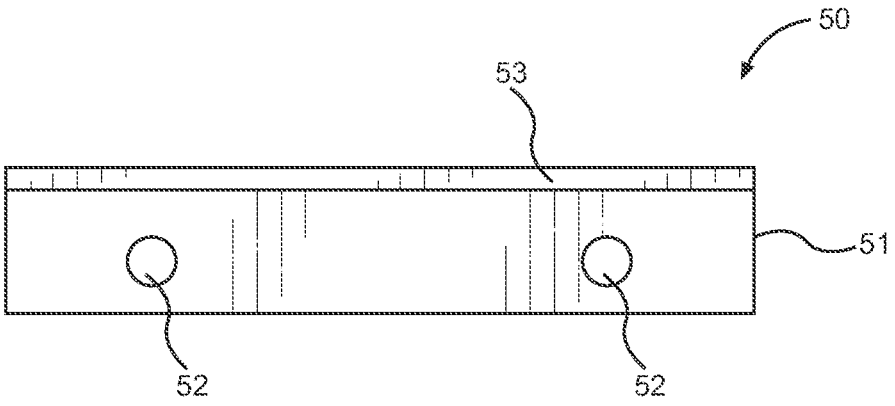
Figure 4B:
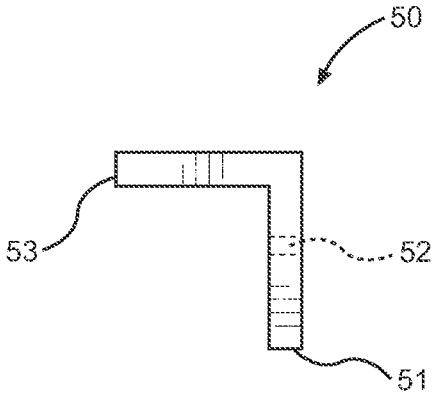
Figure 4C:
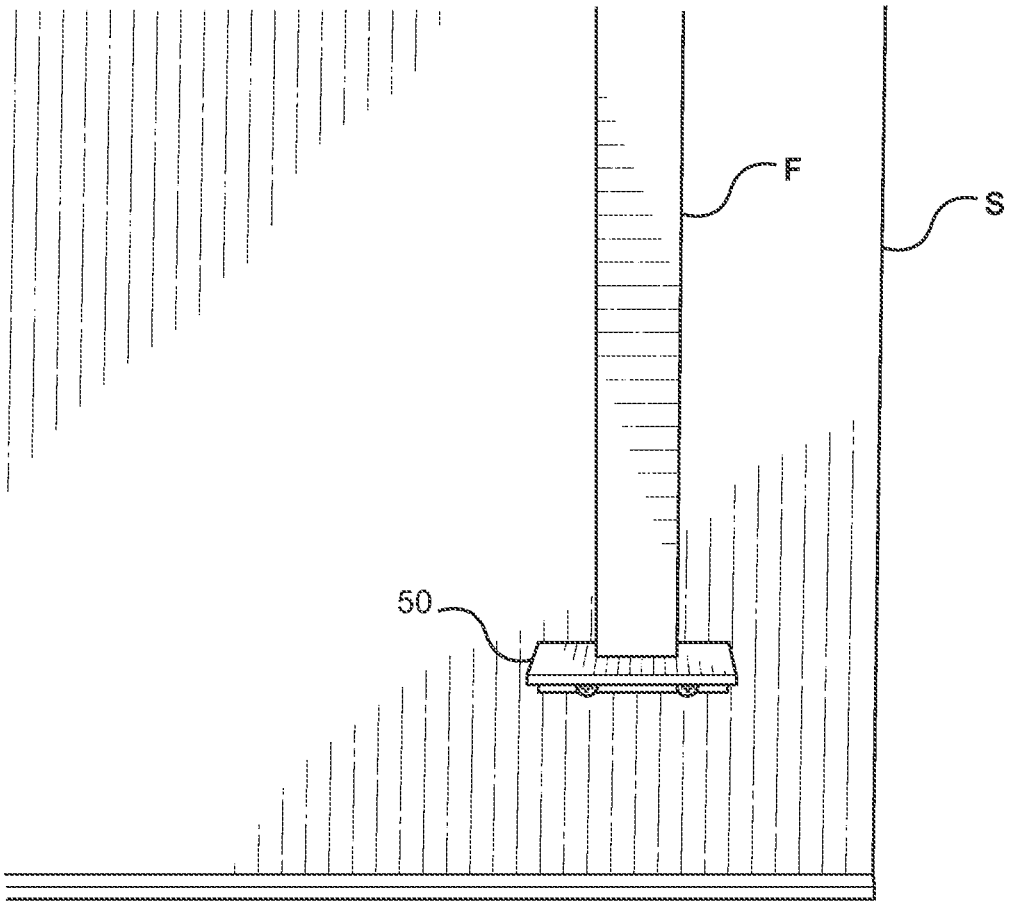

FIGS. 4*a*-4*c* illustrate front, side and mounted views, respectively, of an exemplary embodiment of filter back shelf plate 50 of system 100 for using cloth filters 20 in automated vertical molding. Filter back shelf plate 50 mounts to swing plate S to create a shelf aperture in sand mold M providing additional support for cloth filter 20 after insertion. Filter back shelf plate 50 has a cross-section of an L-shape rotated 90 degrees clockwise.

In the exemplary embodiment, first shelf leg 51 of filter back shelf plate 50 includes a plurality of attachment apertures 52 holding mechanical fasteners that removably mount filter back shelf plate 50 to swing plate S. Second shelf leg 53 has a length ranging from approximately 0.5 inches to approximately 1 inch. Second shelf leg 53 has a width ranging from the side dimension of cloth filter 20 to the side dimension of filter print plate 40. In certain embodiments, attachment apertures 52 are located on second shelf leg 53. In certain embodiments, first shelf leg 51 is longer than second shelf leg 53. In certain embodiments, at least one of first shelf leg 51 or second shelf leg 53 tapers.

FIG. 4*c* shows filter back shelf plate 50 mounted to swing plate S during the founding process. Foundry plank F at least partially surrounds filter back shelf plate 50 to create an aperture in sand mold M.

Figure 5:
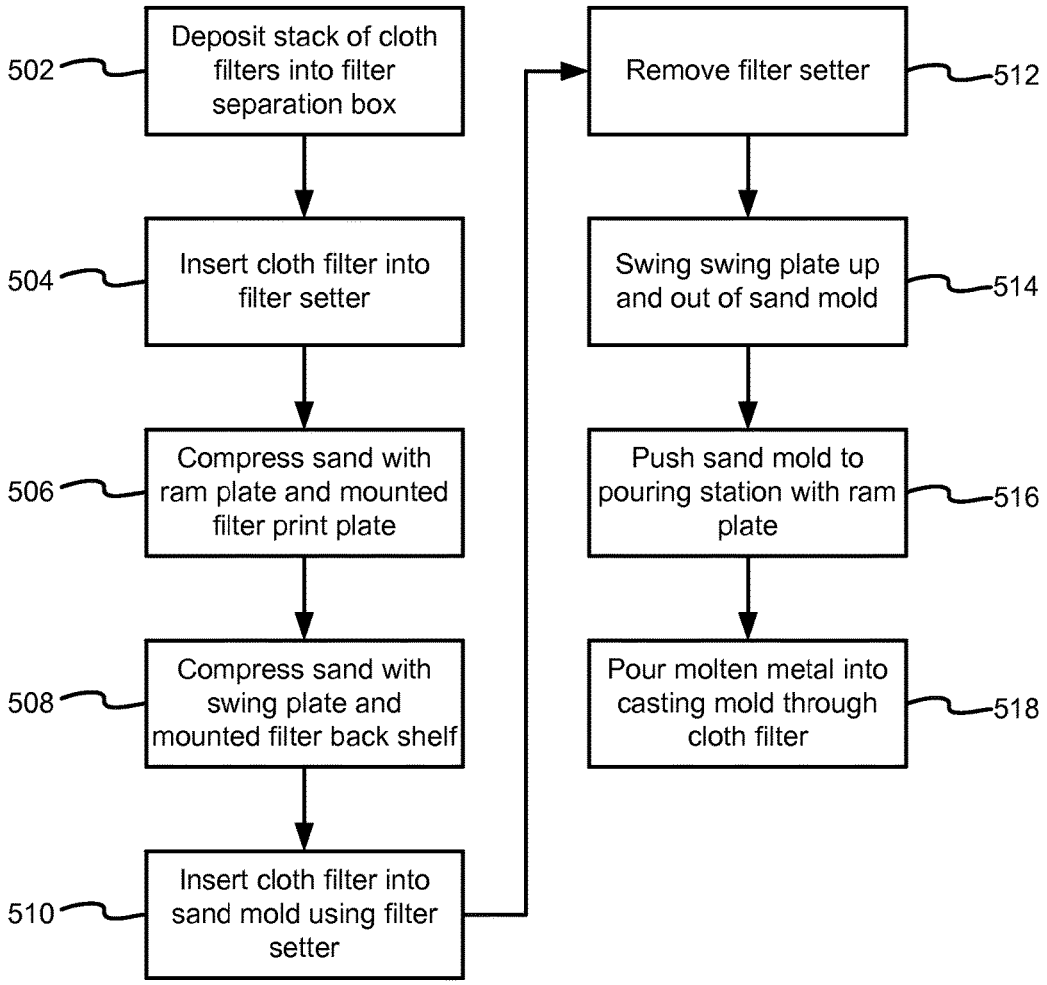
FIG. 5 illustrates a flowchart of an exemplary embodiment of a method for using cloth filters in automated vertical molding.

FIG. 5 illustrates a flowchart of an exemplary embodiment of a method 500 for using cloth filters 20 in automated vertical molding.

In optional step 502, method 500 deposits a stack of cloth filters 20 into filter separation box 10 to disarrange cloth filters 20 and make them easier to individually remove.

In step 504, method 500 inserts a cloth filter 20 into filter setter 30 mounted to a mechanical arm A.

In step 506, ram plate R with mounted filter print plate 40 compresses sand to create sand mold M. Filter print plate 40 creates at least part of a print aperture in sand mold M, within which three edges of cloth filter 20 rest.

In step 508, swing plate S with mounted filter back shelf 50 compresses sand to create sand mold M. Filter back shelf 50 creates a shelf aperture in sand mold M, within which a fourth edge of cloth filter 20 rests. Method 200 may perform steps 506 and 508 substantially simultaneously.

In step 510, mechanical arm A inserts cloth filter 20 into sand mold M using filter setter 30 until an edge of cloth filter 20 rests in the print aperture. In certain embodiments, an ejection cylinder ejects cloth filter 20 into sand mold M.

In step 512, mechanical arm A removes filter setter 30, leaving cloth filter 20 in sand mold M.

In step 514, swing plate S with a mounted filter back shelf 50 swings up and out of sand mold M.

In step 516, ram plate R with mounted filter print plate 40 pushes sand mold M to a pouring station P, where it abuts another sand mold M. One-half of each sand mold M makes up the two halves of a casting mold C. Therefore, a single cloth filter 20 will rest in a filter print of a first sand mold M and in a shelf aperture of a second sand mold M.

In step 518, pouring station P pours molten metal into casting mold C through cloth filter 20 to create a cast part.

Figure 6:
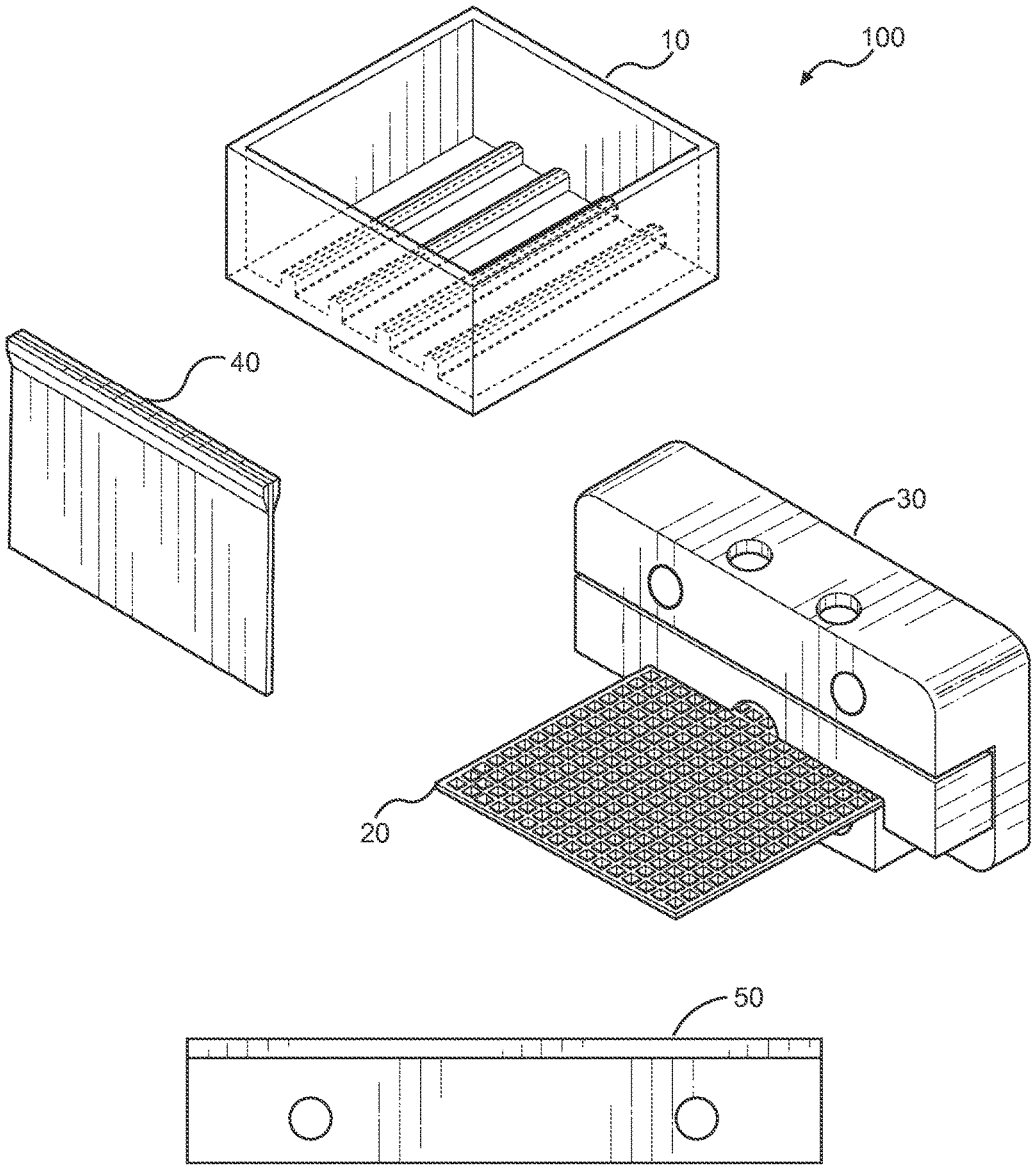
FIG. 6 illustrates a perspective view of an exemplary embodiment of a system for using cloth filters in automated vertical molding.

FIG. 6 illustrates a perspective view of an exemplary embodiment of a system 100 for using cloth filters 20 in automated vertical molding.

It will be understood that many additional changes in the details, materials, procedures and arrangement of parts, which have been herein described and illustrated to explain the nature of the invention, may be made by those skilled in the art within the principle and scope of the invention as expressed in the appended claims.

It should be further understood that the drawings are not necessarily to scale; instead, emphasis has been placed upon illustrating the principles of the invention. Moreover, the terms "substantially" or "approximately" as used herein may be applied to modify any quantitative representation that could permissibly vary without resulting in a change in the basic function to which it is related.

What is claimed is:

1. A system for using cloth filters in automated vertical molding, comprised of:

a filter setter removably mounted to a mechanical arm, wherein said filter setter comprises a housing, at least one upper jaw and at least one lower jaw, wherein at least one cloth filter is releasably located within said filter setter between the at least one upper jaw and the at least one lower jaw;

a filter print plate mounted to a ram plate; and a filter back shelf removably mounted to a swing plate, wherein said filter back shelf has an L-shaped cross-section comprising a first shelf leg and a second shelf leg.

2. The system of claim 1, wherein a width of said at least one upper jaw is approximately equal to or less than a width of said housing.

3. The system of claim 1, wherein a width of said at least one lower jaw is approximately equal to or greater than a width of the at least one cloth filter.

4. The system of claim 1, wherein said at least one upper jaw comprises a plurality of removably attachable upper jaws and said at least one lower jaw comprises a plurality of removably attachable lower jaws.

5. The system of claim 1, wherein said filter print plate has a minimum thickness no less than a thickness of the at least one cloth filter and a maximum thickness no greater than twice said thickness of the at least one cloth filter.

6. The system of claim 1, wherein a side of said filter print plate closest to said ram plate is approximately 2-6 mm wider than the at least one cloth filter.

7. The system of claim 1, wherein a width of said filter print plate proximal to said ram plate is wider than a width of said filter print plate distal to said ram plate.

8. The system of claim 1, wherein a side of said filter print plate closest to said ram plate comprises a tapering or chamfering configuration.

9. The system of claim 1, wherein said first shelf leg of said filter back shelf plate includes a plurality of attachment apertures holding mechanical fasteners removably mounting said filter back shelf plate to said swing plate.

10. The system of claim 1, wherein said second shelf leg of said filter back shelf plate has a length ranging from approximately 0.5 inches to approximately 1 inch.

11. The system of claim 1, wherein said second shelf leg of said filter back shelf plate has a width ranging from a side dimension of said cloth filter to a side dimension of said filter print plate.

12. The system of claim 1, further comprising a filter separation box comprising four walls connected to and surrounding a base, and a plurality of separation structures integral to said base.

13. The system of claim 12, wherein said plurality of separation structures have a cross-sectional shape selected from a group consisting of: a rectangle, a square, a half-circle, an arc or a triangle.

14. The system of claim 12, wherein said plurality of separation structures number between approximately 4 and approximately 10.

15. The system of claim 12, wherein said plurality of separation structures are approximately 0.5 inches to approximately 0.625 inches wide.

16. The system of claim 12, wherein a height of said plurality of separation structures is no less than one-third a length of the at least one cloth filter.

17. The system of claim 12, wherein said plurality of separation structures are spaced apart no more than two-thirds a length of said cloth filter.

* * * * *